United States Patent [19]

Carossino

[11] Patent Number: 4,566,357

[45] Date of Patent: Jan. 28, 1986

[54] UNIVERSAL TOOL-HOLDER

[76] Inventor: Patricia Carossino, 16, Chemin Dupuis Vert, 95000 Cergy, France

[21] Appl. No.: 564,846

[22] Filed: Dec. 23, 1983

[30] Foreign Application Priority Data

Jan. 5, 1983 [FR] France ..... 83 00071

[51] Int. Cl.[4] ..... B25B 23/16

[52] U.S. Cl. ..... 81/177.2; 81/436

[58] Field of Search ..... 81/177 A, 436; 279/9 R, 279/93, 83, 91

[56] References Cited

U.S. PATENT DOCUMENTS

| | | | |
|---|---|---|---|
| 1,420,279 | 6/1922 | Parsons et al. | 81/177 A |
| 2,713,281 | 7/1955 | Poteet | 81/177 A |
| 2,715,028 | 8/1955 | Dossie | 81/177 A X |
| 3,766,811 | 10/1973 | Callahan | 81/177 A X |
| 3,850,056 | 11/1974 | Allen . | |
| 4,007,651 | 2/1977 | Scott . | |

FOREIGN PATENT DOCUMENTS

| | | |
|---|---|---|
| 366774 | 10/1906 | France . |
| 2508367 | 12/1982 | France . |

*Primary Examiner*—James G. Smith

*Attorney, Agent, or Firm*—Andrus, Sceales, Starke & Sawall

[57] ABSTRACT

This invention relates to a universal tool-holder, usable as an accessory in tightening or untightening screwable members by a suitable tool.

The problem posed is to improve the leverage and manipulation of the tool.

In accordance with the invention, the tool-holder comprises a hollow grip (1), and a rotary head (3) secured axially to the grip (1) for rotation relative to the grip, the rotary head (3) presenting an axial aperture (5) and radial aperture (7) which receive and mate with an end of the tool, a locking screw (9) being screwed into a tapped radial aperture (10) in the head (3) to engage and lock the tool in the head. The grip may then be used as a lever handle or a crank handle to apply torque to the tool.

The invention is especially applicable to such tools as a box spanner, a pipe spanner or an Allen key.

9 Claims, 4 Drawing Figures

UNIVERSAL TOOL-HOLDER

BACKGROUND OF THE INVENTION

This invention relates to a universal tool-holder which is usable as an accessory with a separable tool to increase the torque applicable for tightening or untightening screwable members and or for actuating tightening tools, applicable particularly to threaded fasteners such as screw and bolts and so on, to Allen keys, to box spanners and to screwdrivers.

DESCRIPTION OF THE PRIOR ART

In the general field of applied mechanics, both manufacturing and all kinds of mechanical construction, such as the automobile and aeronautical industries and more generally in all fields where parts of all kinds are fastened together by screwable members such as screws and bolts and so on, it is known to use tightening tools or devices of many different kinds, including principally screwdrivers, box spanners, pipe spanners, Allen keys and so on.

However all these different tools have known disadvantages. Thus, in the case of parts fastened by screws, bolts and the like, in places which are often difficult of access, it becomes necessary to use pipe spanners, box spanners or even sometimes either very small screwdrivers or on the contrary very long screwdrivers, but in many cases it is difficult and arduous to effect the tightening or untightening of the screwable members due to the absence of a sufficiently long leverage to be able to tighten the members fully or in any case sufficiently, or to untighten them.

Thus, for example, in the case of a box spanner, or a hexagonal Allen key made in the shape a shaft bent into a right-angle, one arm being short and the other much longer, the tool is engaged on or in the head of the screw by its smaller arm if that is possible, in order to be able to exert more leverage through the longer arm by hand. Even so, rotational drive to tighten or untighten the screw can be difficult, and the manipulation may be hard on the hands.

In order to obtain increased leverage, it is of course possible to use pliers or the like, but besides being somewhat irrational, this can produce harmful twisting moments, and the operator is liable to injury if the pliers or the like slip on the tool.

However, if the accessibility is further reduced, and the Allen key or other tool is to engage the screwable member by its longer arm only the shorter arm is left for tightening or untightening leverage, which further increases the above disadvantages.

Moreover, in the case of a mechanic working underneath a car or a workman working underneath a building framework of any kind, he may encounter not only the same problems as mentioned above, but also another disadvantage resulting from the fact that once the tool is applied to the screwable member it has to be held from falling, while still applying the tightening or untightening rotation.

It will be apparent that, in addition to the intrinsic disadvantages referred to above, this often adds a loss of time and of course a loss of efficiency.

OBJECT OF THE INVENTION

An object of the invention is to provide a tool-holder, for use with a tool as mentioned above, and enabling the leverage and manipulation of the tool to be improved, for example for an Allen key or a screwdriver, with the facility for rotation of the tool through 360° either like a lever handle, or like a crank, while reducing the risk of injury to the user which exists when the tool is simply used by hand. The tool holder is also usable to hold the tool from falling while the screwable member is screwed up or unscrewed.

BRIEF DESCRIPTION OF THE INVENTION

The present invention provides a universal tool holder for receiving and applying torque to a tool for tightening or untightening a screwable member, comprising a grip member defining an axial bore, a rotary head member secured axially to said grip member in said bore for rotation about the axis of said grip member relative to said grip member, said head member presenting at least an axial aperture and a radial aperture, each of said apertures being adapted to receive alternatively a part of said tool, and locking means for releasably engaging said part of said tool in the aperture to secure the tool therein.

In a preferred embodiment of the invention, said rotary head member is of generally circular section and presents an exposed end face, and a neck portion accommodated in said bore, said neck portion presenting a tapped orifice and said grip member including a bolt screwed into said tapped orifice and presenting a head portion, said bore presenting an abutment against which said head portion of said bolt bears, whereby to secure said rotary head member to said grip member.

Preferably, said axial aperture and said radial aperture are of non-cylindrical section, and suitably said axial aperture and said radial aperture are of polygonal section.

Advantageously, said rotary head member presents a tapped aperture extending generally perpendicular to said axial aperture and said radial aperture, said locking means including a screw member for screwing in said tapped aperture to engage said part of said tool, whereby to secure the tool.

The invention also includes a tool set comprising a tool holder as described above and said tool, the sections of said axial aperture and of said radial aperture being noncircular and complementary to the section of said part of said tool which is also non-circular, whereby to prevent rotation of said tool relative to the aperture.

In one embodiment, said tool comprises a long arm and a short arm, and each of said axial aperture and said radial aperture is adapted to receive alternatively said long arm and said short arm.

Preferably, in this embodiment, said tool is a hexagonal Allen key, and said axial and radial apertures are of matching hexagonal section.

In another embodiment, said tool is a screwdriver, said part of said tool being a shaft portion of said screwdriver, said radial aperture extending right through said rotary head member, whereby said tool holder may be positioned at an intermediate position on said shaft portion to apply torque thereto.

DESCRIPTION OF THE DRAWINGS

Other features and advantages of the invention will appear from the following description, given by way of example, with reference to the accompanying drawings, in which.

DESCRIPTION OF THE PREFERRED EMBODIMENTS

Figure 1:
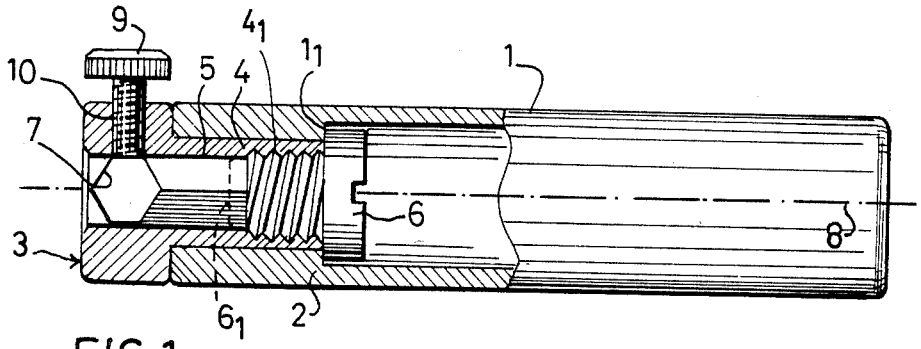
FIG. 1 is a side view, partly in axial section, of a universal tool holder according to the invention.

As shown in FIG. 1, the tool holder comprises essentially a cylindrical grip 1 in the form of a sleeve, its bore comprising an annular shoulder $1_1$ defining a section 2 of reduced diameter compared to the rest of the bore, the projecting shoulder forming an abutment for the head of a bolt whose role will be explained below. The grip is associated with a head 3 of annular shape, extended on one of its faces by a ferrule 4 which is accommodated in the reduced diameter of the grip, the head 3 and ferrule 4 having an axial bore 5 of which a part $4_1$ is tapped to receive a bolt or stop 6 whose head engages on the annular shoulder $1_1$ of the bore of the grip 1. This bolt can readily be screwed into the ferrule 4 through the open end of the grip until it engages the front face of the ferrule 4. This bolt then serves to secure the rotary head 3 to the grip while enabling it to rotate relative to the grip, with the head, the ferrule 4 and the bolt 6 turning together. Moreover, this bolt also forms an axial stop abutment for the tool which, when it is introduced axially in the bore 5, contacts its front end on the end face $6_1$ of the bolt.

Figure 2:
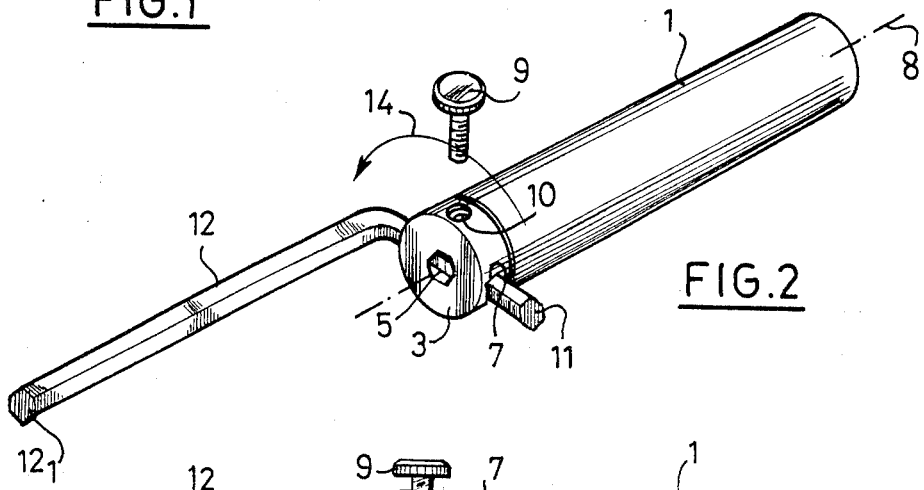
FIG. 2 is a diagrammatic perspective view of a tool assembly, including the tool holder of FIG. 1 in a "crank" type usage position

The rotatable head also comprises two transverse or radial apertures 7 which, in the embodiment illustrated have a hexagonal shape, that is to say a shape matching the part of the tool which, in this embodiment, comprises an Allen key as shown in FIG. 2. These radial apertures 7 are perpendicular to the plane through the axis 8 of the grip and extend right through the head 3 from one side to the other. The rotary head also comprises another radial aperture 10 extending in a plane perpendicular to the axis of the two radial apertures 7, the aperture 10 being tapped to receive a thumb screw 9 whose function is to lock the tool in the rotary head 3 when the tool is introduced axially or transversely into the aperture 5 or the apertures 7. To this end, the aperture 5 is of hexagonal section, similarly to the apertures 7, in the embodiment illustrated, to receive the mating end of the Allen key. The thumb screw 9 applies the tool firmly against the walls of the axial aperture 5 or the radial apertures 7 to immobilise the tool therein so that it is solid with the rotary head 3.

The hexagonal section of the Allen key, as shown in FIG. 2 particularly, is given by way of example and it will be understood that any other suitable type of tool of different section, provided that its section is non-cylindrical and that the shape of the axial aperture 5 or of the radial apertures 7 are complementary to this section. Consequently, it would be possible to give these axial and radial apertures any suitable polygonal shape or even a part cylindrical section, provided that it presents a flat preventing rotation of the tool relative to the head 3, so that the head is solid with the tool once the thumb screw 9 has been tightened.

In the example shown in FIG. 2, the tool-holder is used like a crank. In this case, the Allen key, which comprises a hexagonal rod bent into a right angle, has its shorter arm 11 introduced into the radial apertures 7 of the rotary head 3, the longer arm 12 being disposed in a plane parallel to the axis 8 of the grip. The thumb screw 9 is then introduced into the aperture 10 and screwed down to press the arm 11 in the rotary head so that the two parts are solid with each other. In this position, the tool-holder can be used as a crank by introducing the arm $12_1$ of the key into the head of a hexagonal hollow headed bolt, even if the bolt is disposed at the bottom of a cavity or in an inaccessible place. Thus it is sufficient to hold the grip in one hand and crank it round in the direction of the arrow 14 so that the rotary head 3 rotates through 360 ° relative to the grip, and produces a full turn of the hexagonal bolt. The use of the tool-holder as a crank is especially advantageous, since the fact that the axis of the grip is spaced from the axis of the arm 12 of the key gives the assembly a relatively high tightening torque, which enables members to be screwed down or unscrewed with reduced effort and reduced risk of injury.

It will be understood that the tool-holder can also be used by introducing into the radial apertures 7 the longer arm 12 of the key and using the shorter arm 11 as the member engaging the bolt. In this case, the leverage is even bigger and the tightening or untightening torque is porportionally increased.

Figure 3:
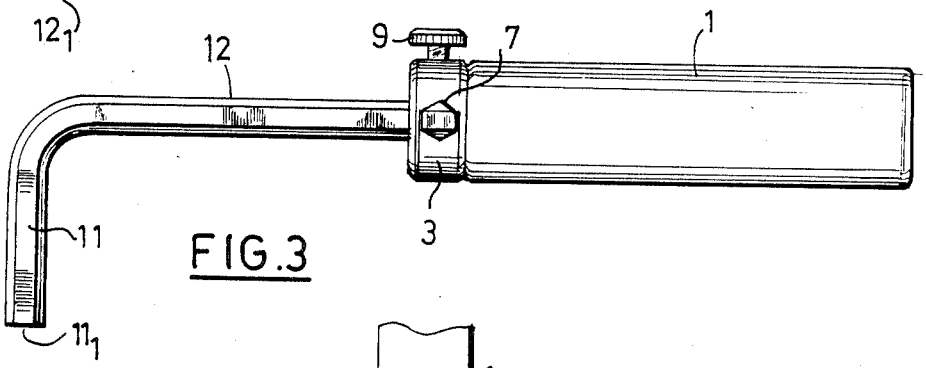
FIG. 3 is a side elevational view of a tool assembly including the tool holder used as a "handle" type lever arm.

In another example, as shown in FIG. 3, the universal tool-holder is used as a handle to give a very substantial increase in the leverage of the Allen key. In this case, it is sufficient to introduce either one of the two arms 11 or 12 of the key into the axial aperture 5 of the rotary head, and screw down the thumb screw 9 to obtain a handle, like a lever door-handle, enabling very high tightening torques to be applied, especially when it is the longer arm 12 which is introduced into the hexagonal aperture 5 of the rotary head 3.

Once again, by choosing the length of the arm introduced into the axial aperture of the rotary head 3 the tightening torque can be selected and especially one can gain access to bolts disposed in cavities which are otherwise relatively inaccessible, while still obtaining a high tightening or untightening torque. In the example shown in FIG. 3, it is the longer arm 12 which has been introduced into the rotary head 3, which is a suitable configuration for a bolt which is relatively accessible and can accept the shorter arm 11. It will be appreciated that in this configuration the leverage has been practically doubled (the length of the grip 1 plus the length of the arm 12 of the key).

Figure 4:
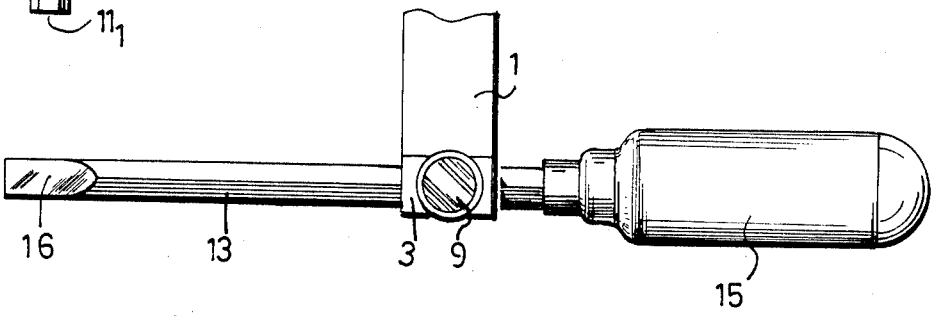
FIG. 4 is a diagrammatic view showing andther advantageous usage of the tool-holder, enabling the tightening that can be obtained from a screwdriver to be improved.

In the alternative shown in FIG. 4, the toolholder in accordance with the invention is used to increase substantially the tightening action of a screwdriver.

To this end, the shaft 13 of the screwdriver (whose grip is indicated at 15) is inserted into the transverse apertures 7 of the head 3, and the head is locked onto the shaft 13 of the screwdriver using the thumb screw 9. Next, the blade end 16 of the screwdriver is inserted in the slot of the screw to be screwed up (or unscrewed) and the grip 1 is used as a handle to exert on the shaft 13 a torque greater than what can be obtained merely by turning the grip 15 of the screw driver by hand.

It will be readily understood that in the cases of hexagonal key shafts or screwdrivers whose shaft is of polygonal cross-section the shaft of the key or of the screwdriver is already locked against rotation relative to the head 3 of the tool-holder and that the tightening of the screw 9 is only necessary to prevent longitudinal movement of the head 3 along the shaft 13 of the tool in question.

It will be appreciated that the locking screw 9 can be provided with notches or any other gripping means on its outer end so as to increase the action of screw in locking the shaft of the key or other tool.

What is claimed:

1. A universal tool holder for receiving and applying torque to a tool for tightening or untightening a screwable member, comprising a grip member defining an axial bore, a rotary head member secured axially to said grip member in said bore and freely rotatable about the axis of said grip member relative to said grip member without relative axial movement between said head and grip members, said head member presenting an axial aperture opening along the axis of said grip member and at least one radial aperture opening normal to the axis of said grip member, each of said apertures being adapted to receive alternatively a part of said tool, and locking means for releasably engaging said part of said tool in the aperture to secure the tool therein.

2. A tool holder as claimed in claim 1 wherein said rotary head member is of generally circular section and presents an exposed end face, and a neck portion accommodated in said bore, said neck portion presenting a tapped orifice and said grip member including a bolt screwed into said tapped orifice and presenting a head portion, said bore presenting an abutment against which said head portion of said bolt bears, whereby to secure said rotary head member to said grip member.

3. A tool holder as claimed in claim 1 wherein said axial aperture and said radial aperture are of non-cylindrical section.

4. A tool holder as claimed in claim 3 wherein said axial aperture and said radial aperture are of polygonal section.

5. A tool holder as claimed in claim 1 wherein said rotary head member presents a tapped aperture extending generally perpendicular to said axial aperture and said radial aperture, said locking means including a screw member for screwing in said tapped aperture to engage said part of said tool, whereby to secure the tool.

6. A tool set comprising a tool and a universal tool holder for receiving and applying torque to said tool for tightening or untightening a screwable member, said universal tool holder comprising a grip member defining an axial bore, a rotary head member secured axially to said grip member in said bore and freely rotatably about the axis of said grip member relative to said grip member without relative axial movement between said head and grip members, said head member presenting an axial aperture opening along the axis of said grip member and at least one radial aperture opening normal to the axis of said grip member, each of said apertures being adapted to receive alternately a part of said tool, and locking means for releasably engaging said part of said tool in the aperture to secure the tool therein, said part of said tool being inserted in one of said axial aperture or radial aperture and secured therein by said locking means, said tool part having a non-circular cross sectional configuration, said axial and radial apertures being complementary in configuration to said tool to prevent rotation of said tool relative to said aperture.

7. A tool set as claimed in claim 6 wherein said tool comprises a long arm and a short arm, and each of said axial aperture and said radial aperture is adapted to receive alternatively said long arm and said short arm.

8. A tool set as claimed in claim 7 wherein said tool is a hexagonal Allen key, and said axial and radial apertures are of matching hexagonal section.

9. A tool set as claimed in claim 6 wherein said tool is a screwdriver, said part of said tool being a shaft portion of said screwdriver, said radial aperture extending through said rotary head member, whereby said tool holder may be positioned at an intermediate position on said shaft portion to apply torque thereto.

* * * * *